US011152745B2

(12) United States Patent
Gates

(10) Patent No.: US 11,152,745 B2
(45) Date of Patent: Oct. 19, 2021

(54) TOOL LOCKING MOUNTING SHELL FOR PROTECTING ELECTRICAL CONNECTIONS IN A HAZARDOUS ENVIRONMENT

(71) Applicant: EATON INTELLIGENT POWER LIMITED, Dublin (IE)

(72) Inventor: Joshua Paul Gates, Kinston, NC (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/872,846

(22) Filed: May 12, 2020

(65) Prior Publication Data

US 2020/0373710 A1 Nov. 26, 2020

Related U.S. Application Data

(60) Provisional application No. 62/851,337, filed on May 22, 2019.

(51) Int. Cl.
*H01R 13/629* (2006.01)
*H01R 13/52* (2006.01)
*H01R 13/639* (2006.01)

(52) U.S. Cl.
CPC ... *H01R 13/62955* (2013.01); *H01R 13/5213* (2013.01); *H01R 13/6397* (2013.01)

(58) Field of Classification Search
CPC ..... H01R 13/62955; H01R 13/6397; H01R 13/5213
See application file for complete search history.

(56) References Cited

U.S. PATENT DOCUMENTS 5,833,484 A * 11/1998 Post ..... H01R 13/62955 439/352
7,789,690 B1 * 9/2010 Rhein ..... H01R 13/53 439/310

(Continued)

FOREIGN PATENT DOCUMENTS

WO WO-2009100964 A1 * 8/2009 ..... H01R 13/6397

OTHER PUBLICATIONS

"Roughneck Single Conductor Connectors", Crouse-Hinds Series By Eaton Corp Inc., 2013, pp. 1480-1485.

(Continued)

*Primary Examiner* — Tho D Ta
(74) *Attorney, Agent, or Firm* — Armstrong Teasdale LLP

(57) ABSTRACT

A connector assembly for electrical contacts has been provided. The connector assembly includes a plug housing, a receptacle housing, and a locking mechanism. The receptacle housing includes a mounting shell. The locking mechanism is mounted on the mounting shell and configured to couple the plug housing with the receptacle housing, the locking mechanism including a latch. The locking mechanism transitions between a locked position and an open position by rotation of the latch. The receptacle housing is configured to engage with the plug housing when the locking mechanism is at the locked position. The receptacle housing is configured to disengage from the receptacle housing when the locking mechanism is at the open position. The locking mechanism further includes a tooled actuator configured to lock the locking mechanism when the locking mechanism is at the locked position, the tooled actuator sized to require a tool to operate the tooled actuator.

19 Claims, 8 Drawing Sheets

(56) References Cited

U.S. PATENT DOCUMENTS

| | | | | |
|---|---|---|---|---|
| 8,221,153 | B2 * | 7/2012 | Svelnis | H01R 13/62955 439/372 |
| 2007/0197074 | A1 * | 8/2007 | Gimbel | H01R 13/5202 439/213 |
| 2011/0275235 | A1 * | 11/2011 | Zapf | H01R 13/6273 439/349 |
| 2012/0295462 | A1 * | 11/2012 | Villarreal | H01R 13/6397 439/304 |
| 2015/0011109 | A1 * | 1/2015 | Jeong | H01R 13/6272 439/304 |
| 2015/0288102 | A1 * | 10/2015 | Szelag | H01R 13/639 439/304 |
| 2017/0187158 | A1 * | 6/2017 | Crowe | H05H 1/34 |
| 2017/0288342 | A1 * | 10/2017 | Nicolas | H01R 13/62955 |

OTHER PUBLICATIONS

"Roughneck Single Conductor Connectivity", Crouse-Hinds Series By Eaton Corp Inc., 2016, 16 pages.
"Roughneck E1049 Series Connectors, Installation and Maintenance Information", Crouse-Hinds Series By Eaton Corp Inc., 2015, 3 pages.

* cited by examiner

TOOL LOCKING MOUNTING SHELL FOR PROTECTING ELECTRICAL CONNECTIONS IN A HAZARDOUS ENVIRONMENT

CROSS REFERENCE TO RELATED APPLICATIONS

This application claims the benefit of U.S. Provisional Application No. 62/851,337, filed May 22, 2019, the entire contents and disclosures of which are hereby incorporated by reference herein in their entirety.

BACKGROUND OF THE DISCLOSURE

The field of the disclosure relates generally to connector assemblies for electrical systems, and more particularly to tool-locking electrical plug and receptacle housings for use in hazardous environments.

Conventional connector assemblies are known to include a plug housing coupled to a receptacle housing with electrical contacts included inside. The receptacle housing includes a mounting shell having a bus bar installed inside. The bus bar is connected to an electrical panel of a power distribution system for supplying power to a load. A locking mechanism is mounted on the mounting shell and used to lock the plug housing with the receptacle housing.

In hazardous environments, such as refineries and petroleum chemical plants, ignitable gas, vapors or dust or otherwise flammable substances are present in the ambient environment of the connector assemblies. In such environments, additional safeguards are therefore required, including but not necessarily limited to securing electrical connections inside physically locked mating housing components to prevent human error and possible ignition risks associated with a disconnection of a circuit under load in the hazardous environment.

While known locking mechanisms are effective to provide the desired interconnections of plug housings with receptacle housings, they are prone to certain problems and improvements are desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION

Figure 1:
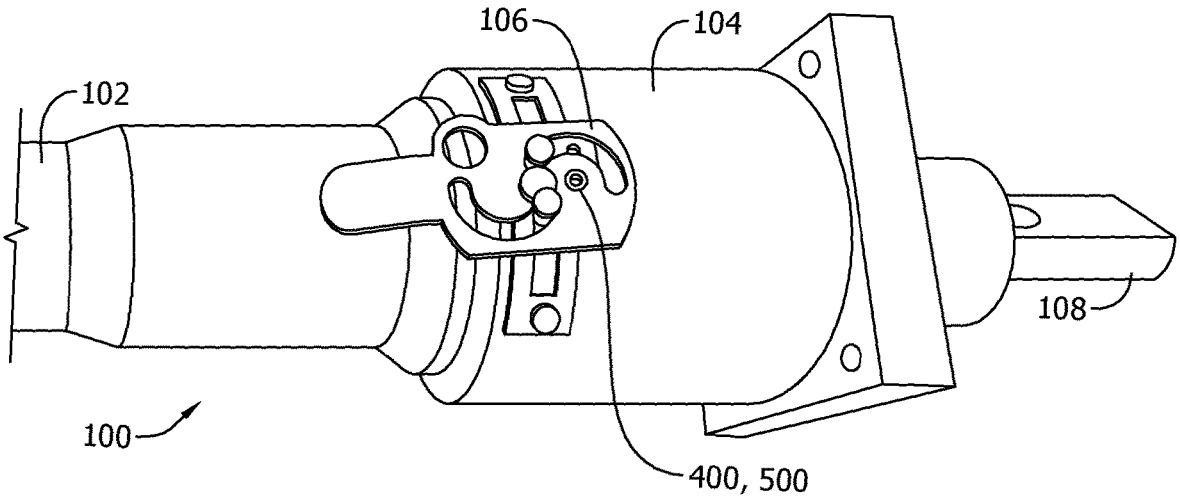
FIG. 1 is a perspective view of an exemplary connector assembly.

Conventional locking mechanisms providing locking of plug housings with receptacle housings in an electrical system are disadvantaged in certain aspects, especially in a hazardous environment. For example, locking mechanisms may be disengaged by a worker in disconnection of the electrical system, not realizing that the electrical contacts inside the plug and receptacle housings are energized, where any arc from disconnection could cause an explosion in the volatile atmosphere of the hazardous environment.

Electrical power systems sometimes operate within hazardous environments presenting a risk of explosion via ignition of a surrounding gas or vapor dusts, fibers, or flyings. Such hazardous environments may arise, for example only, in petroleum refineries, petrochemical plants, grain silos, waste water and/or treatment facilities among other industrial facilities, wherein volatile conditions are produced in the ambient environment and present a heightened risk of fire or explosion. A temporary or sustained presence of airborne ignitable gas, ignitable vapors or ignitable dust or otherwise flammable substances presents substantial concerns regarding safe and reliable operation of such facilities overall, including but not limited to safe operation of the electrical power system itself, which in some instances by virtue of conventional circuit protector devices may produce ignition sources in normal operation and in the presence of an electrical fault. As such, a number of standards have been promulgated relating to electrical product use in explosive environments to improve safety in hazardous locations in view of an assessed probability of explosion or fire risk.

For example, Underwriter's Laboratories ("UL") standard UL 1203 sets forth Explosion-Proof and Dust-Ignition-Proof Electrical Equipment criteria for hazardous locations. Explosion-Proof and Dust-Ignition-Proof enclosures are available to enclose or contain electrical products. In combination with appropriate Explosion-Proof and Dust-Ignition-Proof enclosures, electrical equipment manufacturers may receive UL certification of compliance with the applicable rating standards for hazardous locations, and UL certification is an important aspect of a manufacturer's ability to successfully bring products to market in North America or any other market accepting of UL standard 1203.

The National Electric Code (NEC) generally classifies hazardous locations by class and division. Class 1 locations are those in which flammable vapors and gases may be present. Class II locations are those in which combustible dust may be found. Class III locations are those which are hazardous because of the presence of easily ignitable fibers or flyings. Considering Class 1, Division 1 covers locations where flammable gases or vapors may exist under normal operating conditions, under frequent repair or maintenance operations, or where breakdown or faulty operation of process equipment might also cause simultaneous failure of electrical equipment. Division 1 presents a greater risk of explosion than, for example, Division 2 where flammable gases or vapors are normally handled either in a closed system, confined within suitable enclosures, or are normally prevented by positive mechanical ventilation.

The International Electrotechnical Commission (IEC) likewise categorizes hazardous locations into Class I, Zone 0, 1, or 2 representing locations in which flammable gases or vapors are or may be airborne in an amount sufficient to produce explosive or ignitable mixtures. As defined in the IEC, a Class I, Zone 0 location is a location in which ignitable concentrations of flammable gases or vapors are present continuously or for long periods of time. A Class I, Zone 1 location is a location in which ignitable concentrations of flammable gases or vapors are likely to exist because of repair or maintenance operations or because of leakage or possible release of ignitable concentrations of flammable gases or vapors, or is a location that is adjacent to a Class I, Zone 0 location from which ignitable concentrations of vapors could be communicated.

Given that electrical devices, such as those described below, can be ignition sources in certain circumstances, explosion-proof, flame-proof, or ignition-proof enclosures are conventionally provided in NEC Division 1 or 2 locations and/or IEC Zone 1 or 2 locations to house electrical devices that pose ignition risk. The terms "explosion-proof" or "flame-proof" in this context, refer to enclosures that are designed to be capable of containing an internal explosion of a specified flammable vapor-air mixture.

Plug and receptacle housings disclosed herein are used to contain hazards and/or protect electrical contacts from exterior hazards. Plug and receptacle housings therefore are locked together and stay locked once a connector assembly is assembled. Under IEC Zone 2 standards, the use of a tooled feature is required to actuate the locking mechanism that locks a plug housing with a receptacle housing to prevent unplanned disengagement of the plug housing from the receptacle housing. Method aspects in this disclosure will be in part apparent and in part explicitly discussed in the following description.

FIG. 1 shows an exemplary connector assembly 100. Connector assembly 100 includes a plug housing 102, a receptacle housing 104, and a locking mechanism 106. Connector assembly 100 may further include a bus bar 108. Bus bar 108 may be connected to a load to supply power to the load or a power line to receive power supply from the power line.

In operation, plug housing 102 is coupled with receptacle housing 104 in connector assembly 100 shown in FIG. 1. Plug housing 102 may be disengaged from receptacle housing 104. Locking mechanism 106 is at the locked position in connector assembly 100 as shown in FIG. 1, where plug housing 102 is prevented from disengaging from receptacle housing 104 by locking mechanism 106. Locking mechanism 106 may also be in an open position such that plug housing 102 can be disengaged from or inserted into receptacle housing 104.

In some embodiments, connector assembly 100 is weatherproof and provides a high level of indestructibility, which is suitable for hazardous environments. They are built to take heavy abuse and are resistant to wind, rain, mud, oil, and sea water, yet can be quickly connected and disconnected. Locking mechanism 106 locks plug housing 102 and receptacle housing 104 together, to prevent disruption of service and electrical shock hazards. Plug housing 102 and receptacle housing 104 are configured to receive and shield electrical contacts. Connector assembly 100 provides a safe high amperage connector, for example for carrying current having amperage as high as approximately 1030 A and/or alternating current or direct current (AD/DC) voltage of 1000 V.

Figure 2A:
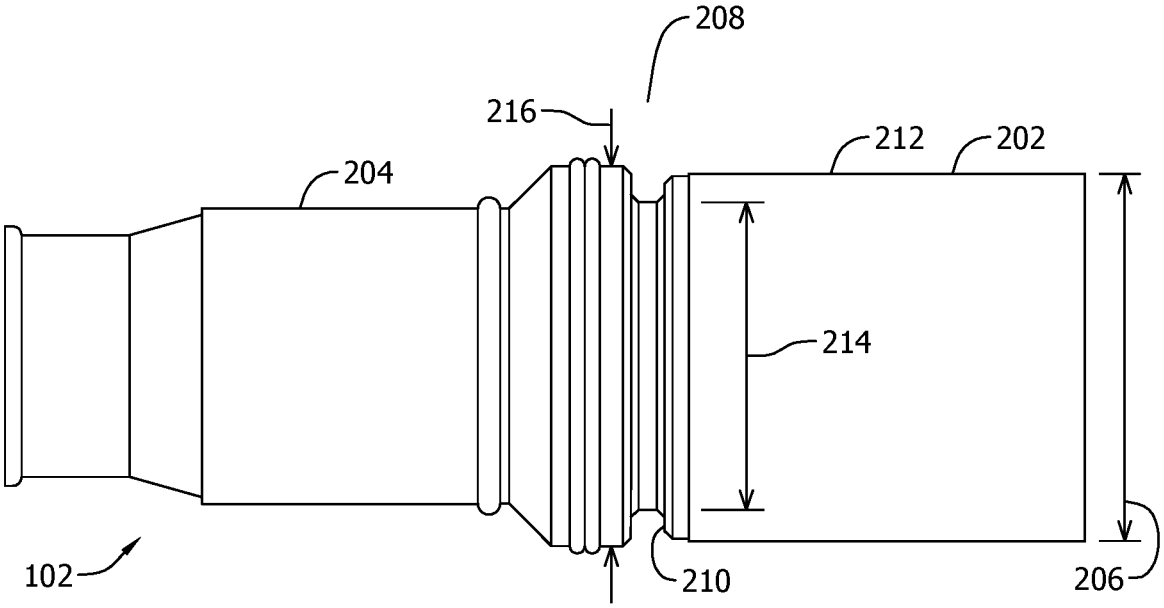
FIG. 2A is a side view of a plug housing of the connector assembly shown in FIG. 1.
Figure 2B:
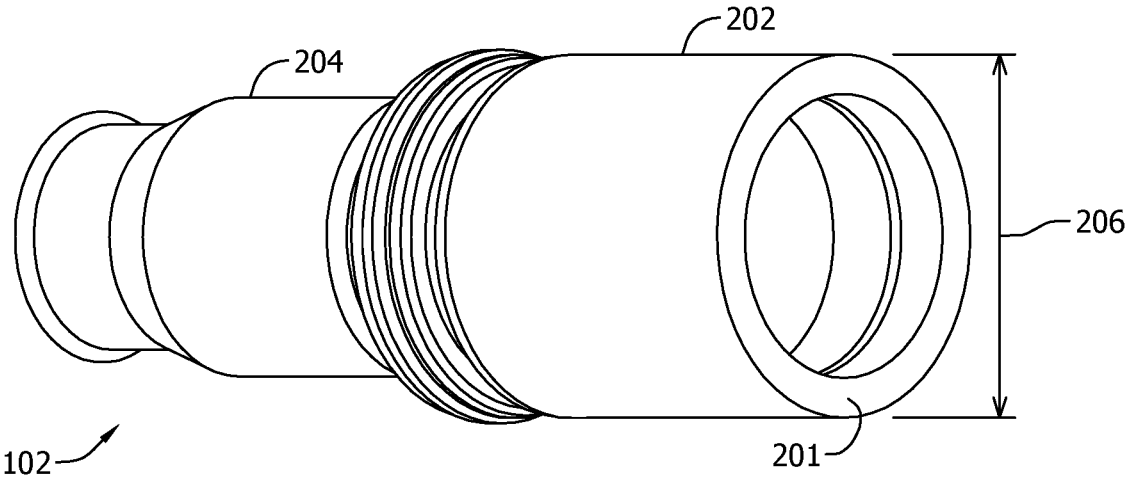
FIG. 2B is a top perspective view of the plug housing shown in FIG. 2A.

FIGS. 2A and 2B show a side view and a side-perspective view of exemplary plug housing 102. In the exemplary embodiment, a cross-section 201 of plug housing 102 is cylindrical. Cross-section 201 may be in other shape that enables plug housing 102 to function as disclosed herein, including but not limited to elliptical, rectangular, square, or combination thereof. Plug housing 102 may be epoxy powder coated. The coating may be color-coded. In some embodiments, plug housing 102 may be made of rubber. Plug housing 102 may be color-coded by being molded to a color.

In the exemplary embodiment, plug housing 102 includes a proximal end 202, where plug housing 102 is configured to be coupled with receptacle housing 104. Plug housing 102 further includes a distal end 204 opposite proximal end 202. Plug housing 102 has a first outer diameter 206 at proximal end 202. Plug housing 102 further includes a plug locking ring 208.

In the exemplary embodiment, plug locking ring 208 includes a groove 210 formed and positioned on an outer surface 212 of plug housing 102. Plug locking ring 208 has a second outer diameter 214 at groove 210. Second outer diameter 214 is measured at the lowest portion of groove 210. Plug housing 102 may have a third outer diameter 216 measured at the location of plug housing 102 adjacent to groove 210 at the side of groove 210 distal to proximal end 202. Third outer diameter 216 is larger than first outer diameter 206.

Figure 3A:
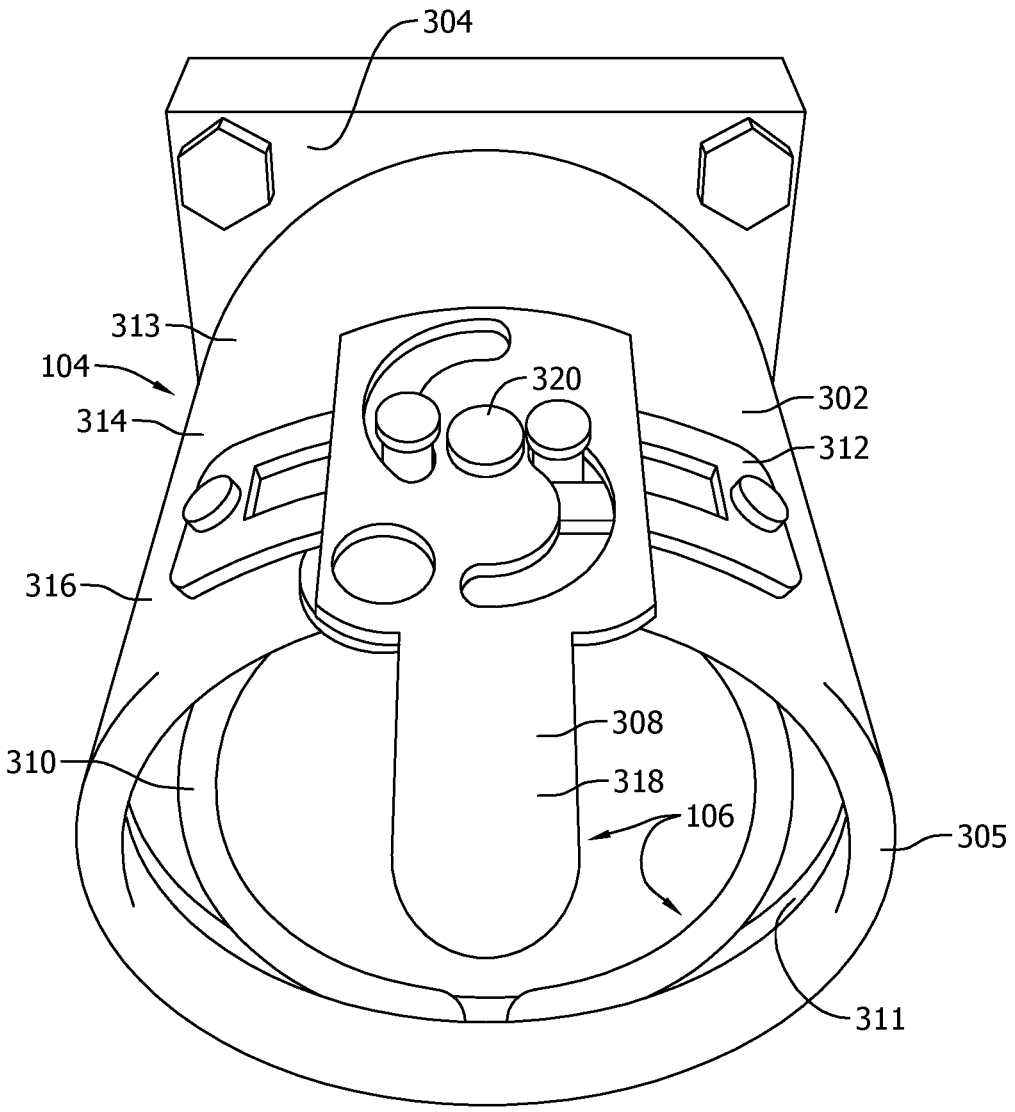
FIG. 3A is a perspective front view of a receptacle housing and a locking mechanism of the connector assembly shown in FIG. 1.
Figure 3B:
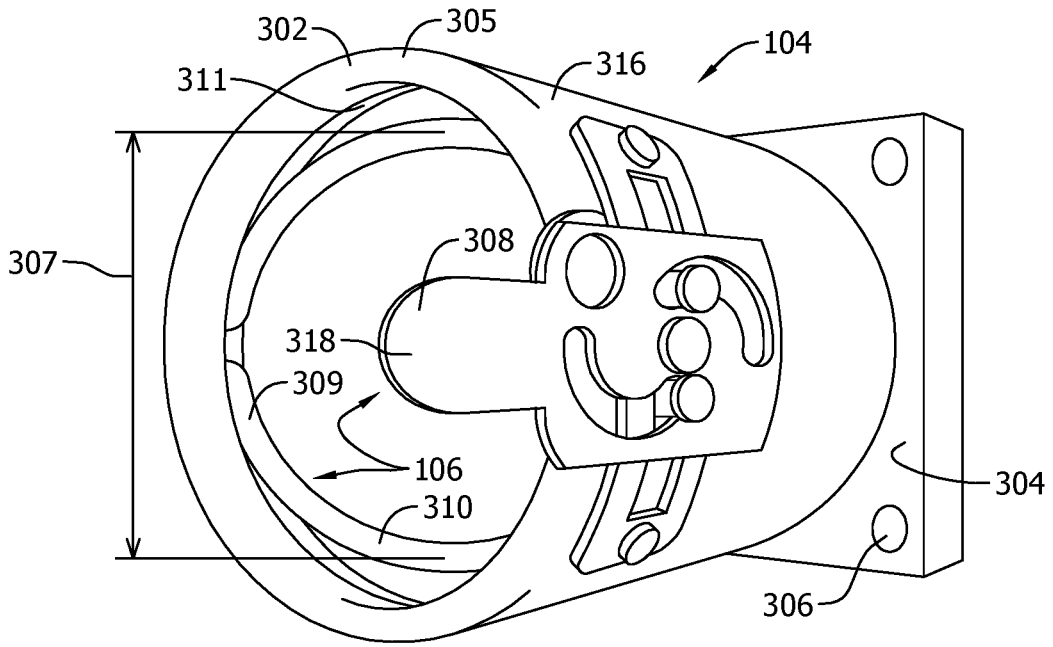
FIG. 3B is a top perspective view of the receptacle housing and locking mechanism shown in FIG. 3A when the locking mechanism is at a locked position.
Figure 3C:
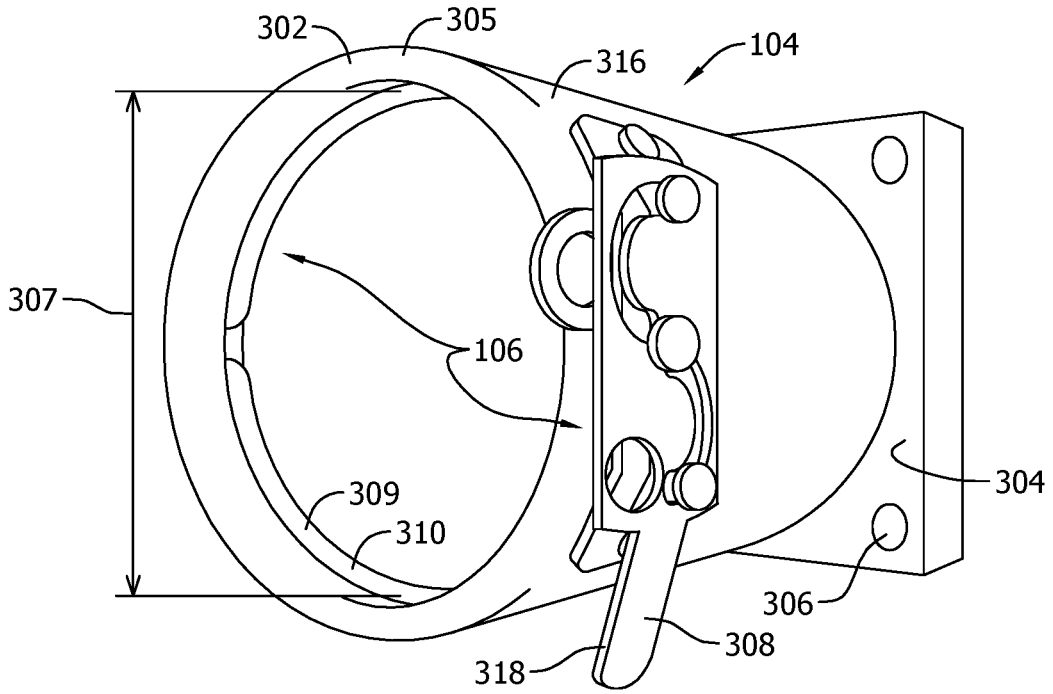
FIG. 3C is a top perspective view of the receptacle housing and locking mechanism shown in FIG. 3A when the locking mechanism is at an open position.

FIGS. 3A-3C show exemplary receptacle housing 104 and locking mechanism 106. FIG. 3A is a front perspective view of receptacle housing 104 and locking mechanism 106, FIGS. 3B and 3C show top perspective views of receptacle housing 104 when locking mechanism 106 is at the locked position (FIG. 3B) or at the open position (FIG. 3C).

In the exemplary embodiment, receptacle housing 104 includes a mounting shell 302. Mounting shell 302 may include a mounting plate 304. Mounting plate 304 includes one or more mounting holes 306 (shown in FIGS. 3B and 3C) for mounting receptacle housing 104 onto an electrical panel or another structure.

Mounting shell 302, for example, is made of aluminum. Mounting shell 302 may be made of other material that enables mounting shell 302 to function as described herein, including but not limited to stainless steel. Mounting shell 302 may also be epoxy powder coated. The coating of plug housing 102 and receptacle housing 104 may be color-coded for easy circuit identification when mating plug housing 102 with receptacle housing 104. Color coding also helps prevent reverse phasing on AC circuits or cross-polarization on DC circuits to assure correct rotation of motors while providing for operator safety. In the exemplary embodiment, cross-section 305 of mounting shell 302 at an end 316 is circular. Cross-section of mounting shell 302 may be in other shape that matches the shape of cross-section 201 of plug housing 102 and enables receptacle housing 104 to function as disclosed herein.

In the exemplary embodiment, locking mechanism 106 includes a latch 308 and a rod 310. Rod 310 is disposed inside receptacle housing 104. Rod 310 may be disposed in a groove 311 on a wall 313 of mounting shell 302. Rod 310 forms a circle, oval, ellipse, or other shapes having an inner diameter 307. Inner diameter 307 is measured at the narrowest portion of a shape 309 formed by rod 310 (see FIGS. 3B and 3C). Locking mechanism 106 may further include a bracket 312. Bracket 312 may be mounted on an outer surface 314 of receptacle housing 104 adjacent to end 316 of mounting shell 302. Bracket 312 is used to secure latch 308 onto receptacle housing 104. Bracket 312 may be a flat bracket that can be fitted onto a cylindrical surface, such as outer surface 314 of receptacle housing 104.

In the exemplary embodiment, latch 308 includes a handle 318, and an anchor 320. Latch 308 couples to rod 310 at anchor 320. Latch 308 and rod 310 are made of stainless steel. Latch 308 and/or rod 310 may be made of other material that enables latch 308 and rod 310 to function as described herein, including but not limited to steel, copper, and brass. Latch 308 and rod 310 may be made of different material. Latch 308 may further include curved slots that ends of rod 310 follow when latch 308 rotates.

In operation, the locking and opening of the locking mechanism 106 is accomplished by rotation of handle 318. The rotation of handle 318 rotates rod 310 in and out such that diameter 307 of shape 309 formed by rod 310 changes. When locking mechanism 106 is at the locked position, rod 310 is constricted and closes in, and diameter 307 is decreased (shown in FIG. 3B). When locking mechanism is at the open position, rod 310 relaxes back and the circumference of shape 309 constructed by rod 310 enlarges, i.e., diameter 307 is increased. Further, when locking mechanism is at the locked position, diameter 307 is smaller than first outer diameter 206 of plug housing 102 at proximal end 202 but larger than second outer diameter 214 of plug housing 102 at groove 210 (see FIGS. 2A and 2B).

To insert plug housing 102 into receptacle housing 104, locking mechanism 106 is at the open position. With diameter 307 of shape 309 formed by rod 310 larger than first outer diameter 206 of plug housing 102, plug housing 102 can be inserted into receptacle housing 104. Plug housing 102 may have third outer diameter 216 adjacent to groove 210 that is larger than first outer diameter 206 at proximal end 202, which can be used to stop plug housing 102 from being inserted too far into receptacle housing 104. Once rod 310 is disposed in plug locking ring 208 or plug housing 102 is stopped from being further inserted into receptacle housing 104, handle 318 is turned and rod 310 constricts to be positioned further into groove 210. As a result, locking mechanism 106 locks plug housing 102 and receptacle housing 104 together.

Because locking mechanism 106 locks and opens through rotation of latch 308, any worker can unlock plug housing 102 from receptacle housing 104 by rotating latch 308. In a hazardous environment, such a convenience can be dangerous because the electrical system is often energized and disconnection of an energized electrical system could cause an explosion due to arcs from disconnection. In the exemplary embodiments, locking mechanism 106 of connector assembly 100 further includes a tooled actuator 400, 500 (see FIGS. 1 and 4A-5C). Tooled actuator is used to prevent unplanned unlocking of locking mechanism 106. The actuation of tooled actuator requires a tool that belongs to a dedicated worker who is familiar with the correct procedures for assembling and dissembling a connector assembly.

Figure 4A:
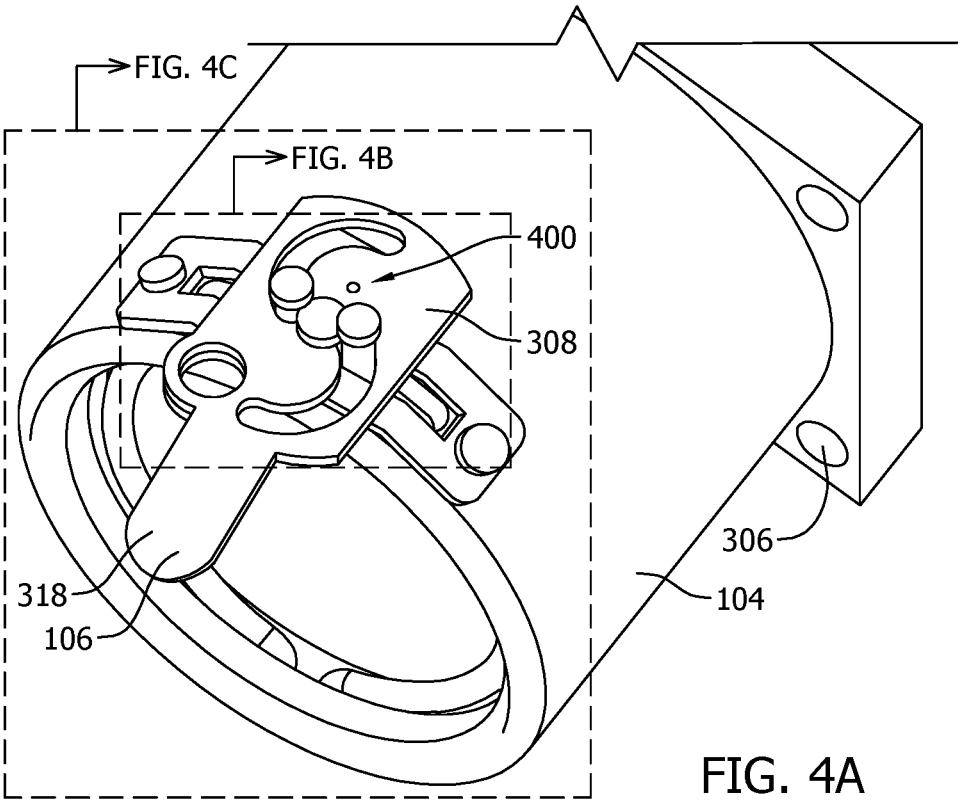
FIG. 4A is an enlarged perspective view of the receptacle housing and locking mechanism shown in FIG. 3A, having an exemplary tooled actuator.
Figure 4B:
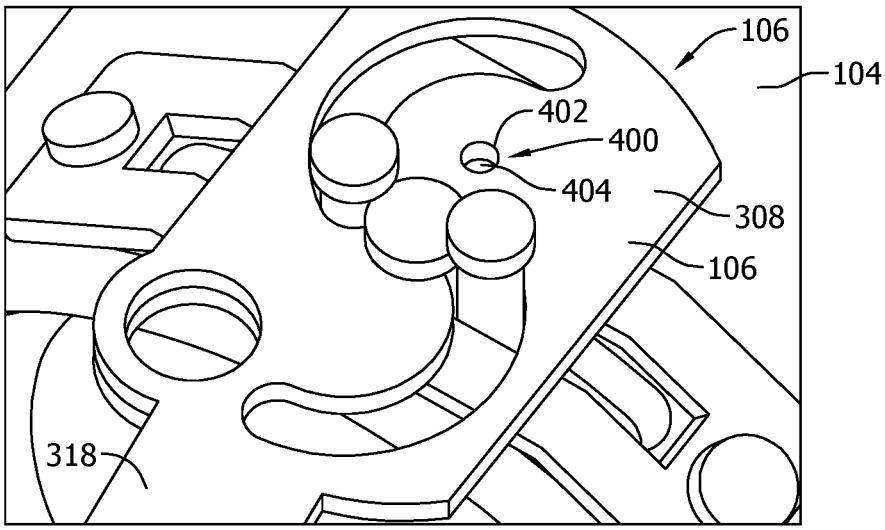
FIG. 4B shows a zoomed-in view of the receptacle housing and locking mechanism shown in FIG. 4A.
Figure 4C:
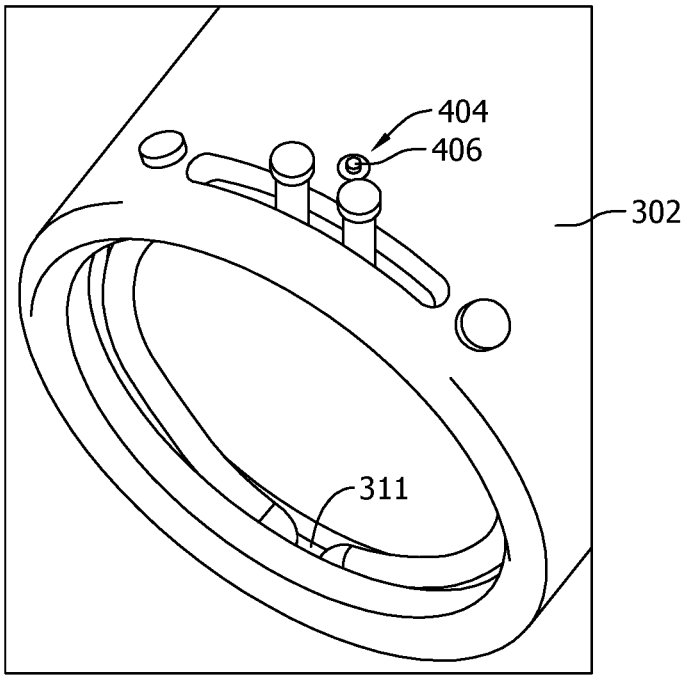
FIG. 4C shows a zoomed-in view of the receptacle housing shown in FIG. 4A.

FIGS. 4A-4C show an exemplary tooled actuator 400. FIG. 4A shows a zoomed-in view of receptacle housing 104 and locking mechanism 106. Locking mechanism 106 includes tooled actuator 400. FIG. 4B shows further zoomed-in view of receptacle housing 104 and locking mechanism 106. FIG. 4C shows mounting shell 302 by itself, without latch 308 being mounted on. In the exemplary embodiment, tooled actuator 400 includes an aperture 402 and a plunger 404. Aperture 402 is disposed through latch 308. Aperture 402 is sized smaller than a human finger such that a tool is required to be inserted into aperture 402 to actuate plunger 404. Such a tool may be a pin sized to be fitted in aperture 402. Plunger 404 includes a plunger head 406. Plunger head 406 is sized to fit into aperture 402 (see FIGS. 4B and 4C). Plunger 404 may be a spring plunger, in which plunger head 406 springs back and forth when force is applied.

In operation, when locking mechanism 106 is locked, plunger 404 is aligned with aperture 402. A tool is inserted into aperture 402 to apply force onto plunger head 406 such that plunger head 406 springs up and is positioned in aperture 402 to lock locking mechanism 106. To unlock locking mechanism 106, the tool is inserted into aperture 402 to apply force on plunger head 406 such that plunger head 406 is pushed down and disengages from aperture 402. Accordingly, locking mechanism 106 does not become unlocked without the actuation of tooled actuator 400.

Figure 5A:
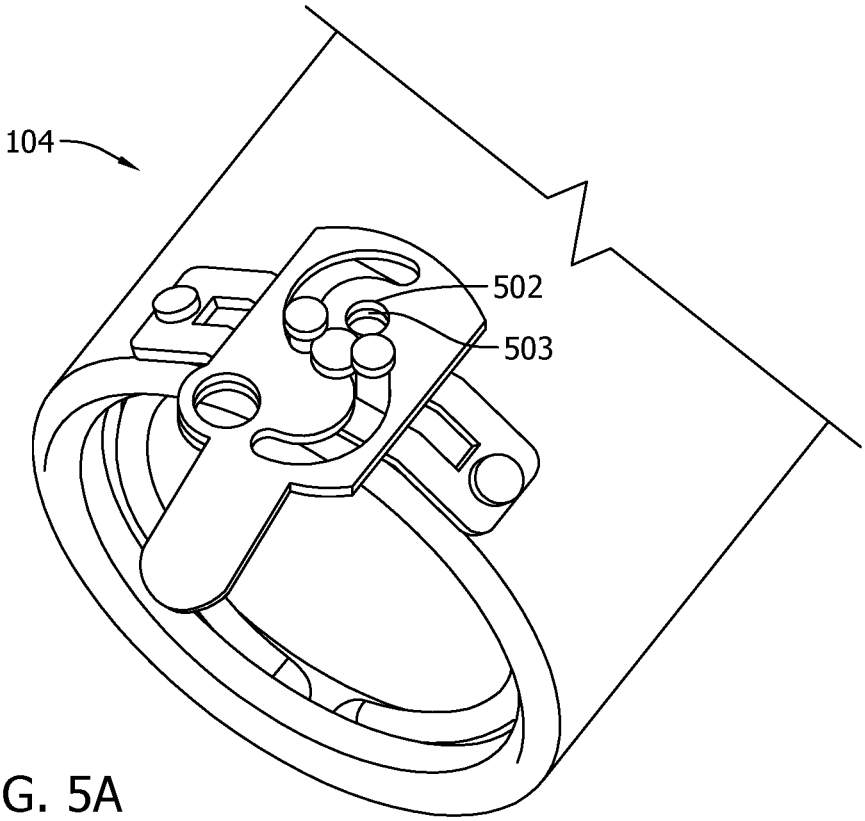
FIG. 5A shows a perspective view of the receptacle housing and locking mechanism shown in FIG. 3A, having another exemplary tooled actuator without a set screw installed.
Figure 5B:
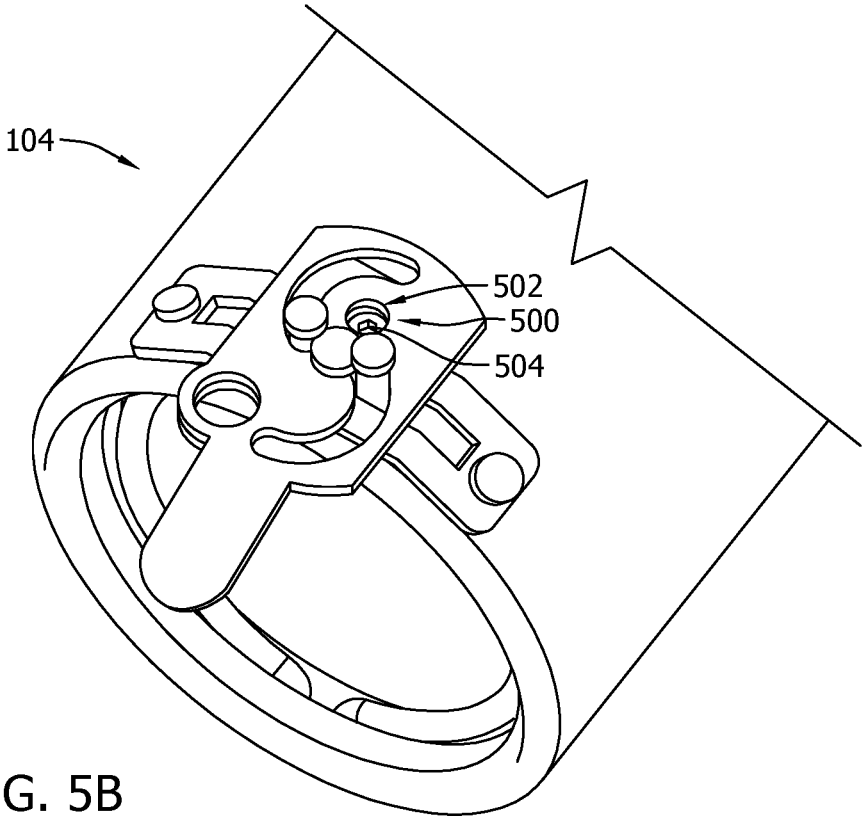
FIG. 5B shows the receptacle housing and locking mechanism shown in FIG. 5A with a set screw installed and the tooled actuator at an unactuated position.
Figure 5C:
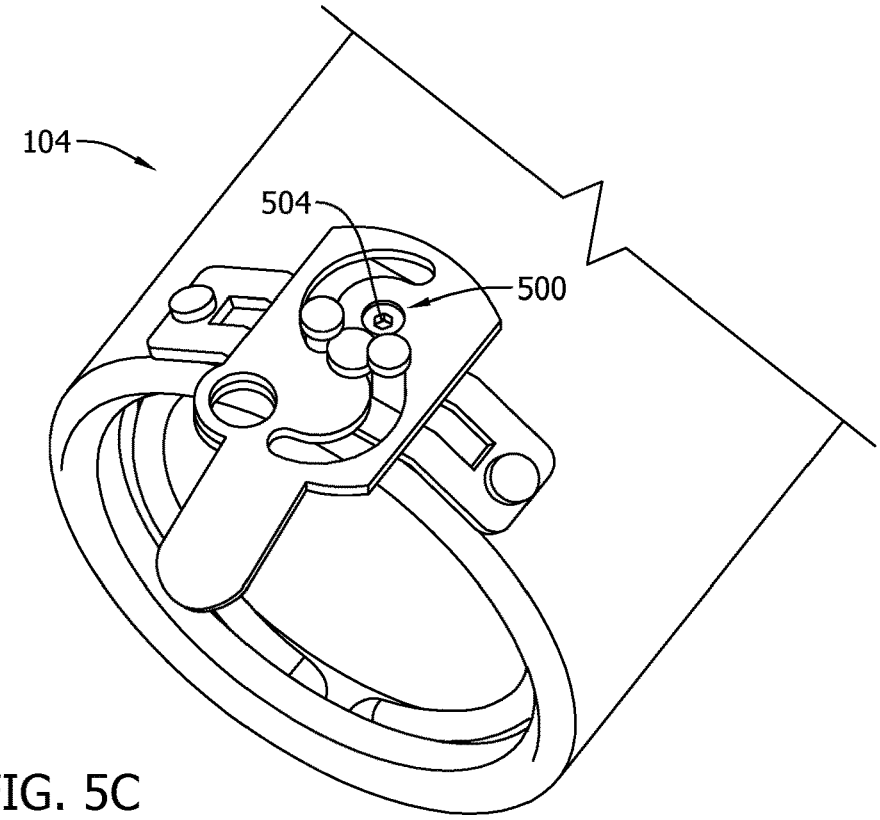
FIG. 5C shows the receptacle housing and locking mechanism shown in FIG. 5A with a set screw installed and the tooled actuator at an actuated position.

FIGS. 5A-5C show another exemplary tooled actuator 500. Tooled actuator 500 includes an aperture 502 and a set screw 504. FIG. 5A shows receptacle housing 104 includes tooled actuator 500 without set screw 504 installed, while FIGS. 5B and 5C show tooled actuator 500 with set screw 504 installed. Tooled actuator 500 is unactuated in FIG. 5B and is actuated in FIG. 5C. Aperture 502 includes threads 503 on its wall. Set screw 504 includes threads that are complimentary to threads 503 of aperture 502 such that threads of set screw 504 can engage with threads 503 of aperture 502 for set screw 504 to be engaged in aperture 502. Set screw 504 includes an aperture at its screw head that fits with an Allen wrench or other tools to rotate set screw 504 in and out of aperture 502.

In operation, to lock locking mechanism 106 when it is at the locked position, set screw 504 is threaded into aperture 502 with a tool, with set screw 504 disposed inside aperture 502. To unlock locking mechanism, set screw 504 may be screwed out of or further into aperture 502 such that set screw 504 is outside aperture 502.

Figure 6:
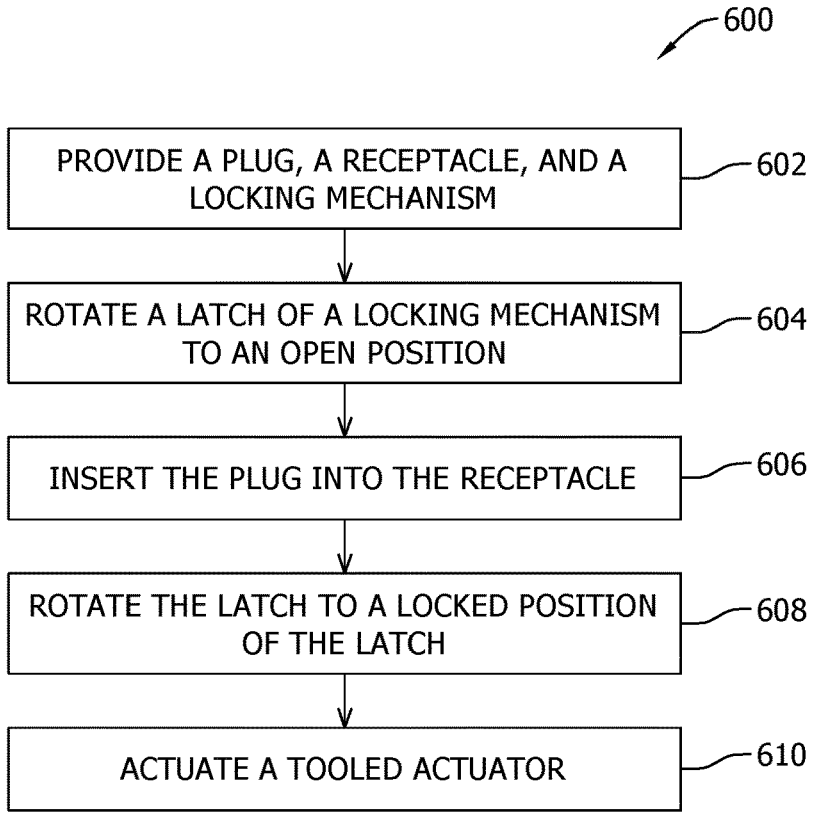
FIG. 6 is a flow chart illustrating an exemplary method of fabricating a connector assembly with the locking mechanisms and tooled actuators shown in FIGS. 1-5C.

FIG. 6 shows an exemplary method 600 of fabricating a connector assembly. Method 600 includes providing 602 a plug housing, a receptacle housing, and a locking mechanism. The connector assembly may include any of the examples or embodiments described above. Method 600 further includes rotating 604 a latch of the locking mechanism such that the locking mechanism is at an open position. Method 600 also includes inserting 606 the plug housing into the receptacle housing. Further, method 600 includes rotating 608 the latch such that the locking mechanism is at a locked position. Moreover, method 600 includes actuating 610 a tooled actuator to lock the locking mechanism.

In the exemplary embodiment, method 600 may further include actuating the tooled actuator to unlock the locking mechanism and rotating the latch such that the locking mechanism is at an open position. Method 600 may include disengaging the plug housing from the receptacle housing when the locking mechanism is at the open position.

The configurations of the plug housing and receptacle housing may be reversed from the embodiments illustrated in another contemplated embodiment. That is, the receptacle housing may be inserted into a plug housing with a locking mechanism positioned on the outer surface of the plug housing.

Various embodiments of connector assemblies are described herein including a locking mechanism having a tooled actuator, where the tooled actuator locks and unlocks the locking mechanism and is actuated by a tool, thereby increasing the safety of connector assemblies, as well as complying with the IEC standards, e.g., IEC60079-15. Further, the locking mechanism is locked and unlocked by the rotation of a latch, thereby increasing the speed in assembling and dissembling connector assemblies.

The benefits and advantages of the inventive concepts are now believed to have been amply illustrated in relation to the exemplary embodiments disclosed.

An embodiment of a connector assembly for electrical contacts has been disclosed. The connector assembly includes a plug housing, a receptacle housing, and a locking mechanism. The plug housing is configured to receive a first electrical contact. The receptacle housing is configured to receive a second electrical contact that is configured to couple to the first electrical contact, the receptacle housing including a mounting shell. The locking mechanism is mounted on the mounting shell of the receptacle housing and configured to couple the plug housing with the receptacle housing, the locking mechanism including a latch. The locking mechanism transitions between a locked position and an open position by rotation of the latch. The receptacle housing is configured to engage with the plug housing when the locking mechanism is at the locked position. The receptacle housing is configured to disengage from the receptacle housing when the locking mechanism is at the open position. The locking mechanism further includes a tooled actuator configured to lock the locking mechanism when the locking mechanism is at the locked position, the tooled actuator sized to require a tool to operate the tooled actuator.

Optionally, the tooled actuator includes an aperture disposed through the latch and sized to require a tool to be inserted into the aperture to operate the tooled actuator. The tooled actuator further includes a plunger, the plunger further includes a plunger head sized to be received in the aperture, the plunger head is positioned in the aperture when the tooled actuator is actuated, and the plunger head is positioned outside the aperture when the tooled actuator is unactuated. The tooled actuator further includes a set screw having threads on its outer surface, and the aperture is sized to receive the set screw therein and further includes threads disposed on its wall that are complimentary to the threads of the set screw. The plug housing further includes a plug locking ring formed on an outer surface of the plug housing, the receptacle housing further including a rod positioned inside the mounting shell, and the rod and the plug locking ring configured to engage with each other when the locking mechanism is at the locked position. The plug locking ring includes a groove formed on the outer surface of the plug housing, the rod closes in and is disposed in the groove when the latch is at the locked position, and the rod relaxes back and disengages from the groove when the latch is at the open position.

Another embodiment of a connector assembly for electrical contacts is disclosed. The connector assembly includes a plug housing, a receptacle housing, and a locking mechanism. The plug housing is configured to receive a first electrical contact. The receptacle housing is configured to receive a second electrical contact that is configured to couple to the first electrical contact, the receptacle housing including a mounting shell. The locking mechanism is mounted on the mounting shell and configured to couple the plug housing with the receptacle housing. The receptacle housing is configured to engage with the plug housing when the locking mechanism is at a locked position. The receptacle housing is configured to disengage from the receptacle housing when the locking mechanism is at an open position. The locking mechanism further includes a tooled actuator configured to lock the locking mechanism when the locking mechanism is at the locked position, the tooled actuator sized to require a tool to operate the tooled actuator.

Optionally, the tooled actuator includes an aperture disposed through the latch and sized to require a tool to be inserted into the aperture to operate the tooled actuator. The tooled actuator further includes a plunger, the plunger further includes a plunger head sized to be received in the aperture, the plunger head is positioned in the aperture when the tooled actuator is actuated, and the plunger head is positioned outside the aperture when the tooled actuator is unactuated. The tooled actuator further includes a set screw having threads on its outer surface, and the aperture further includes threads on its wall that are complimentary to the threads of the set screw. The locking mechanism includes a latch and transitions between the locked position and the open position by rotation of the latch. The plug housing further includes a plug locking ring formed on an outer surface of the plug housing, the receptacle housing including a rod positioned inside the mounting shell, the rod and the plug locking ring configured to engage with each other when the locking mechanism is at the locked position. The plug locking ring includes a groove formed on the outer surface of the plug housing, the rod closes in and is disposed in the groove when the latch is at the locked position, and the rod relaxes back and disengages from the groove when the latch is at the open position.

One more embodiment of a connector assembly for electrical contacts is disclosed. The connector assembly includes a plug housing, a receptacle housing, and a locking mechanism. The plug housing is configured to receive a first electrical contact. The receptacle housing is configured to receive a second electrical contact that is configured to couple to the first electrical contact, the receptacle housing including a mounting shell. The locking mechanism is mounted on the mounting shell of the receptacle housing and configured to couple the plug housing with the receptacle housing, the locking mechanism including a latch. The locking mechanism transitions between a locked position and an open position by rotation of the latch. The receptacle housing is configured to engage with the plug housing when the locking mechanism is at the locked position. The receptacle housing is configured to disengage from the receptacle housing when the locking mechanism is at the open position.

Optionally, the locking mechanism further includes a tooled actuator configured to lock the locking mechanism when the locking mechanism is at the locked position, the tooled actuator sized to require a tool to operate the tooled actuator. The tooled actuator includes an aperture disposed through the latch, the aperture sized to require a tool to be inserted into the aperture to operate the tooled actuator. The tooled actuator further includes a plunger, the plunger further includes a plunger head sized to be received in the aperture, the plunger head is positioned in the aperture when the tooled actuator is actuated, and the plunger head is positioned outside the aperture when the tooled actuator is unactuated. The tooled actuator further includes a set screw having threads on its outer surface, and the aperture further includes threads on its wall that are complimentary to the threads of the set screw. The plug housing further includes a plug locking ring formed on an outer surface of the plug housing, the receptacle housing including a rod positioned inside the mounting shell, and the rod and the plug locking ring configured to engage with each other when the locking mechanism is at the locked position. The plug locking ring includes a groove formed on the outer surface of the plug housing, the rod closes in and is disposed in the groove when the latch is in the locked position, and the rod relaxes back and disengages from the groove when the latch is in the open position.

While exemplary embodiments of components, assemblies and systems are described, variations of the components, assemblies and systems are possible to achieve similar advantages and effects. Specifically, the shape and the geometry of the components and assemblies, and the relative locations of the components in the assembly, may be varied from that described and depicted without departing from inventive concepts described. Also, in certain embodiments certain components in the assemblies described may be omitted to accommodate particular types of electrical contacts or the needs of particular installations, while still providing cost effective connector assemblies for electrical wiring or cabling.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A connector assembly for electrical contacts, comprising:

a plug housing configured to receive a first electrical contact;

a receptacle housing configured to receive a second electrical contact that is configured to couple to the first electrical contact, the receptacle housing including a mounting shell; and a locking mechanism mounted on the mounting shell of the receptacle housing and configured to couple the plug housing with the receptacle housing, the locking mechanism comprising a latch, wherein the locking mechanism transitions between a locked position and an open position by rotation of the latch, the receptacle housing is configured to engage with the plug housing when the locking mechanism is at the locked position, the receptacle housing is configured to disengage from the plug housing when the locking mechanism is at the open position, and the locking mechanism further comprises a tooled actuator configured to lock the locking mechanism when the locking mechanism is at the locked position, the tooled actuator sized to require a tool to operate the tooled actuator to lock the locking mechanism when the locking mechanism is at the locked position.

2. The connector assembly of claim 1, wherein the tooled actuator comprises an aperture disposed through the latch and sized to require the tool to be inserted into the aperture to operate the tooled actuator.

3. The connector assembly of claim 2, wherein the tooled actuator further comprises a plunger, the plunger further includes a plunger head sized to be received in the aperture, the plunger head is positioned in the aperture when the tooled actuator is actuated, and the plunger head is positioned outside the aperture when the tooled actuator is unactuated.

4. The connector assembly of claim 2, wherein the tooled actuator further comprises a set screw having threads on its outer surface, and the aperture is sized to receive the set screw therein and further comprises threads disposed on its wall that are complimentary to the threads of the set screw.

5. The connector assembly of claim 1, wherein the plug housing further comprises a plug locking ring formed on an outer surface of the plug housing, the receptacle housing further comprising a rod positioned inside the mounting shell, and the rod and the plug locking ring configured to engage with each other when the locking mechanism is at the locked position.

6. The connector assembly of claim 5, wherein the plug locking ring comprises a groove formed on the outer surface of the plug housing, the rod closes in and is disposed in the groove when the latch is at the locked position, and the rod relaxes back and disengages from the groove when the latch is at the open position.

7. A connector assembly for electrical contacts, comprising:

a plug housing configured to receive a first electrical contact;

a receptacle housing configured to receive a second electrical contact that is configured to couple to the first electrical contact, the receptacle housing including a mounting shell; and a locking mechanism mounted on the mounting shell and configured to couple the plug housing with the receptacle housing, wherein the receptacle housing is configured to engage with the plug housing when the locking mechanism is at a locked position, the receptacle housing is configured to disengage from the plug housing when the locking mechanism is at an open position, and the locking mechanism further comprises a tooled actuator configured to lock the locking mechanism when the locking mechanism is at the locked position, the tooled actuator sized to require a tool to operate the tooled actuator to lock the locking mechanism when the locking mechanism is at the locked position.

8. The connector assembly of claim 7, wherein the locking mechanism comprises a latch and transitions between the locked position and the open position by rotation of the latch.

9. The connector assembly of claim 7, wherein the locking mechanism further comprises a latch, and the tooled actuator comprises an aperture disposed through the latch and sized to require the tool to be inserted into the aperture to operate the tooled actuator.

10. The connector assembly of claim 9, wherein the tooled actuator further comprises a plunger, the plunger further includes a plunger head sized to be received in the aperture, the plunger head is positioned in the aperture when the tooled actuator is actuated, and the plunger head is positioned outside the aperture when the tooled actuator is unactuated.

11. The connector assembly of claim 9, wherein the tooled actuator further comprises a set screw having threads on its outer surface, and the aperture further comprises threads on its wall that are complimentary to the threads of the set screw.

12. The connector assembly of claim 7, wherein the plug housing further comprises a plug locking ring formed on an outer surface of the plug housing, the receptacle housing comprising a rod positioned inside the mounting shell, the rod and the plug locking ring configured to engage with each other when the locking mechanism is at the locked position.

13. The connector assembly of claim 12, wherein the plug locking ring comprises a groove formed on the outer surface of the plug housing, the rod closes in and is disposed in the groove when the locking mechanism is at the locked position, and the rod relaxes back and disengages from the groove when the locking mechanism is at the open position.

14. A connector assembly for electrical contacts, comprising:

a plug housing configured to receive a first electrical contact;

a receptacle housing configured to receive a second electrical contact that is configured to couple to the first electrical contact, the receptacle housing including a mounting shell; and a locking mechanism mounted on the mounting shell of the receptacle housing and configured to couple the plug housing with the receptacle housing, the locking mechanism comprising a latch, wherein the locking mechanism transitions between a locked position and an open position by rotation of the latch, the receptacle housing is configured to engage with the plug housing when the locking mechanism is at the locked position, and the receptacle housing is configured to disengage from the plug housing when the locking mechanism is at the open position, the locking mechanism further comprising a tooled actuator sized to require a tool to operate to lock the locking mechanism when the locking mechanism is at the locked position.

15. The connector assembly of claim 14, wherein the tooled actuator comprises a latch and an aperture disposed through the latch, the aperture sized to require the tool to be inserted into the aperture to operate the tooled actuator.

16. The connector assembly of claim 15, wherein the tooled actuator further comprises a plunger, the plunger further includes a plunger head sized to be received in the aperture, the plunger head is positioned in the aperture when the tooled actuator is actuated, and the plunger head is positioned outside the aperture when the tooled actuator is unactuated.

17. The connector assembly of claim 15, wherein the tooled actuator further comprises a set screw having threads on its outer surface, and the aperture further comprises threads on its wall that are complimentary to the threads of the set screw.

18. The connector assembly of claim 14, wherein the plug housing further comprises a plug locking ring formed on an outer surface of the plug housing, the receptacle housing comprising a rod positioned inside the mounting shell, and the rod and the plug locking ring configured to engage with each other when the locking mechanism is at the locked position.

19. The connector assembly of claim 18, wherein the plug locking ring comprises a groove formed on the outer surface of the plug housing, the rod closes in and is disposed in the groove when the latch is in the locked position, and the rod relaxes back and disengages from the groove when the latch is in the open position.

* * * * *